US006116071A

United States Patent [19]

Cernuschi et al.

[11] Patent Number: 6,116,071

[45] Date of Patent: Sep. 12, 2000

[54] ROLLING MILL FOR SIZING TUBES OR CYLINDRICAL BODIES IN GENERAL IN THE IRON AND STEEL INDUSTRY

[75] Inventors: Ettore Cernuschi; Vincenzo Palma, both of Milan, Italy

[73] Assignee: Demag Italimpianti S.p.A., Genova, Italy

[21] Appl. No.: 09/147,681

[22] PCT Filed: Jun. 30, 1997

[86] PCT No.: PCT/EP97/03400

§ 371 Date: May 10, 1999

§ 102(e) Date: May 10, 1999

[87] PCT Pub. No.: WO98/06515

PCT Pub. Date: Feb. 19, 1998

[30] Foreign Application Priority Data

Aug. 13, 1996 [IT] Italy ..... MI96A1750

[51] Int. Cl.[7] ..... B21B 13/10; B21B 13/08

[52] U.S. Cl. ..... 72/224; 72/234

[58] Field of Search ..... 72/224, 234, 235, 72/238, 237, 239, 227, 200, 202

[56] References Cited

U.S. PATENT DOCUMENTS

| | | | |
|---|---|---|---|
| 4,397,169 | 8/1983 | Staat | 72/203 |
| 5,331,835 | 7/1994 | Palma et al. | 72/224 |
| 5,765,423 | 6/1998 | Cattaneo et al. | 72/224 |

FOREIGN PATENT DOCUMENTS

| | | | |
|---|---|---|---|
| 565 772 | 10/1993 | European Pat. Off. . | |
| 593 709 | 4/1994 | European Pat. Off. . | |
| 719 600 | 7/1996 | European Pat. Off. . | |
| 59-104209 | 10/1984 | Japan . | |
| 62-230413 | 3/1988 | Japan . | |
| 07 314 013 | 5/1995 | Japan | 72/224 |
| 7-314013 | 4/1996 | Japan . | |

OTHER PUBLICATIONS

J. Ammerling, "Flexibility of 3–Roll Technology for Reducing and Sizing High–Quality Bars", *Iron and Steel Engineer*, Pittsburgh, US, vol. 67, No. 8, Aug. 1990, pp. 33–37.

W.–J. Ammerling, "Neue Generation Von Kombinierten 3–Walzen–Blocken in Stabstahl–Und Drahtstrassen", *Stahl Und Eisen*, vol. 115, No. 2, pp. 47–50.

E. Blos, "New Developments in Rod Mills", *Iron and Steel Engineer*, Pittsburgh, US, vol. 63, No. 12, Dec. 1986 pp. 35–46.

*Primary Examiner*—Rodney Butler
*Attorney, Agent, or Firm*—Nixon & Vanderhye P.C.

[57] ABSTRACT

The invention relates to a rolling mill for sizing tubes or cylindrical bodies such as bars, rods and so on, and is intended for the iron and steel industry. The rolling mill is made up of a multiplicity of fixed three-roll rolling units, i.e. of the type known per se in which the position of the rolls cannot be adjusted under load and they are kinematically connected to each other so as to be set in rotation simultaneously, downstream of which are a multiplicity of adjustable three-roll rolling units. In the latter units the position of the rolls can be adjusted even under load and the purpose of these is to carry out the finishing of the work that is to be sized. The invention enables excellent use to be made of the characteristics of strength of the fixed units and of accurate working of the adjustable units, with the result that it is possible to build an inexpensive but high-performance rolling mill. In a preferred embodiment, in the adjustable units the rolls are mounted on lever-type arms pivoting in planes lying radially with respect to the rolling axis.

11 Claims, 3 Drawing Sheets

ROLLING UNITS

| | FIXED | | | | | | | | | | ADJUSTABLE | | |
|---|---|---|---|---|---|---|---|---|---|---|---|---|---|
| 04 | 1 | 2 | 3 | 4 | 5 | 6 | 7 | 8 | 9 | 10 | 11 | 12 | 13 |
| 4 | x | x | | | | | | | | | x | x | |
| 5 | x | x | x | | | | | | | | | x | x |
| 6 | x | x | x | x | | | | | | | x | x | |
| 7 | x | x | x | x | x | | | | | | | x | x |
| 8 | x | x | x | x | x | x | | | | | x | x | |
| 9 | x | x | x | x | x | x | x | | | | | x | x |
| 10 | x | x | x | x | x | x | x | x | | | x | x | |
| 11 | x | x | x | x | x | x | x | x | x | | | x | x |
| 12 | x | x | x | x | x | x | x | x | x | x | x | x | |

ROLLING MILL FOR SIZING TUBES OR CYLINDRICAL BODIES IN GENERAL IN THE IRON AND STEEL INDUSTRY

FIELD OF THE INVENTION

The present invention relates to a rolling mill of the type intended in particular for the iron and steel industry, for sizing tubes or cylindrical bodies.

The term "sizing" is here used to refer to that phase in the working of tubes, rods, bars or anything else in the iron and steel industry that can be described as a cylindrical body, in which a semi-finished product produced earlier is rolled out to its final dimensions.

BACKGROUND OF THE INVENTION

In the particular case of tubes, what takes place during sizing is essentially a reduction in the diameter of a semi-finished product, in order to reach its nominal value, because the thickness of the wall is usually reached through previous stages of the production cycle which can be carried out by rolling the material around a mandrel using rolling mills of a type commonly known by the abbreviation MPM, or on so-called push benches, or on machines known as "plug mills" etc. See for example on the matter the Japanese Patent Application No. 07314013.

Consequently the sizing of a tube may include the stage of withdrawing the mandrel, if this is made necessary by the previously executed process; that of reduction, whether by stretching or otherwise, and that of finishing with the aim of finally reaching the tolerances required in the production cycle.

Similar considerations to those indicated above with regard to tubes can also be applied, with the appropriate modifications, to the cylindrical bodies referred to earlier.

At present, the usual preference is for sizing to be carried out on rolling mills employing rolling units or stands (both of these terms will be used hereinafter with the same meaning) containing three driven rolls, as these have been found to give good performance as regards the surface finish of the wrought products.

With this type of rolling mill, a very common configuration is that in which the three rolls of the rolling stands are arranged with their respective axes of rotation lying along the sides of an equilateral triangle and are connected to each other via bevel gears, enabling them to be rotated simultaneously by the application of drive to only one of them; in this form the adjustment of the distance between the rolls and the rolling axis is small because the abovementioned configuration will not allow any large movement, it being necessary to keep the bevel gears in mesh. In practice, with this type of rolling mill it is possible to make only a very small adjustment in the positions of the rolls, by adjusting the supporting mechanisms of their bearings; most significantly, it should be pointed out that, under load, that is to say during the processing of a tube or cylindrical body, there is no possibility of making any adjustment.

Because of the low operational flexibility of rolling stands of this type, for brevity's sake they will be referred to below as fixed or fixed-type stands.

It should also be noted that the low flexibility of rolling mills made up of this type of stand requires that for output ranges of tubes comprising a large number of diameters, a large bank of rolling stands must be prepared, because in practice each diameter of tube to be made requires the availability of a set of stands set up specifically to form the rolling mill.

In order to remedy this situation, special rolling units with three or more driven rolls whose positions with respect to a rolling axis can be adjusted even under load, have recently been developed; examples of such rolling units are disclosed in the Italian Patent Applications Nos. MI92A000917 (also European Patent Application No. 92118389.3) and MI93A000704 (also International Patent Application No. PCT/EP/93/00898), both laid open and filed by the owner of this application. In these rolling units the rolls are mounted at the ends of respective lever-type arms which are hinged, at the opposite end from the rolls, to a container having the form essentially of a closed frame that can be removed from an external supporting structure of the rolling unit: each roll is also provided with a mechanism for adjusting the distance between it and the rolling axis, the mechanism acting on the metal blocks that support the bearings of the rolls.

Also known are rolling mills in which the positions of the rolls of each stand are adjustable with respect to the rolling axis by means of a cam system.

In order to distinguish them from the fixed stands referred to earlier, or brevity's sake this second type of rolling unit will here be referred to as an adjustable or adjustable-type unit.

The prevailing trend at the moment in rolling mill manufacture is for an all-identical configuration: this means that they use rolling stands or units that are all identical to each other; this is partly in order to achieve an economy of scale in the production of such stands or units, and partly because with this approach they are made interchangeable in a way that is advantageous when rolls are being changed: as is well known, operating a rolling mill involves periodic re-turning of the rolls as a consequence of the inevitable problems of wear which in the long term cause damage to their surfaces. The operation of machine-turning the rolls of the so-called finishing stands, that is the last stands in the series which produce the accurate diameter, is much more frequent than that of the roughing stands, because wear in the former cannot be tolerated beyond certain limits without compromising the final dimensional tolerance. When the thickness removed from each roll by the periodical re-turning becomes such that the profile of its groove is no longer suitable for producing a certain diameter of a tube or cylindrical body, the entire stand, or the roll container, in the case of rolling units as in the abovementioned patent applications, is moved one or more positions back up the mill to a position where the rolls can operate on a larger diameter.

However, in these rolling mills having all-identical configuration, difficulties arise in their management from a production point of view.

As far as fixed-stand rolling mills are concerned, the stands must be set up at the beginning of the working cycle and, once adjusted, their position can no longer be changed during the sizing of a piece because of their rigid manner of operation.

However, when it comes to mills whose rolling units can be adjusted even under load, the variations that are always present in the production parameters such as, for example, the temperature of a semi-finished product, the environmental conditions in which sizing is being carried out, the composition of the material of the semi-finished product and hence its suitability to being rolled, the possible presence of a reheating furnace between the first stands or units that carry out the extraction and/or first reduction of a tube and the final stands or units that carry out finishing, make the entire production control apparatus exceedingly complicated; it is scarcely necessary to point out that computerized control systems are used for this purpose which, in response to changes in the abovementioned parameters, send signals to the various rolling units to update the positions of the rolls on the basis of complex calculations.

Furthermore, although their performance is better than that of fixed-stand rolling mills, in the case of adjustable-type rolling units maintenance is required of all the control and adjustment systems. This inevitably raises the running costs when compared with the more conventional configuration of fixed-stand rolling mills; although, therefore, such an increase in costs may be justified in some cases, e.g. where great precision is required, in the case of work that is less demanding from this point of view it may cause a loss of competitiveness with regard to the price of the final product.

The object of the present invention is to provide a rolling mill for sizing tubes or cylindrical bodies in general in the iron and steel industry, having structural and functional characteristics that will make it possible to overcome the drawbacks described above.

SUMMARY OF THE INVENTION

This object is achieved by a rolling mill whose characteristics are set out in the claims accompanying this description.

BRIEF DESCRIPTION OF THE DRAWINGS

The invention will now be described in greater detail with reference to the accompanying drawings which show a preferred but not exclusive embodiment thereof; in particular.

DETAILED DESCRIPTION OF THE PREFERRED EMBODIMENT

Figures 1, 4:
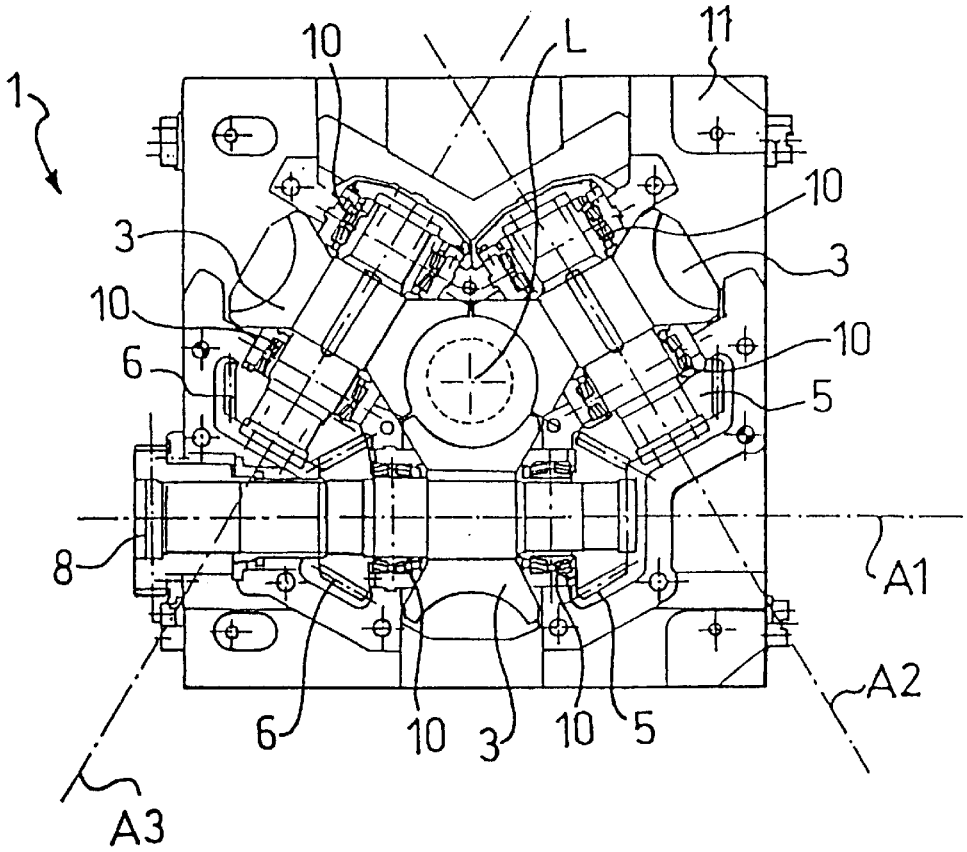
FIG. 1 shows a front view of a first rolling unit present in the rolling mill according to the invention.
FIG. 4 shows a diagram in the form of a matrix showing possible configurations of the rolling mill according to the invention.

The rolling mill according to the invention consists of an in-line arrangement of fixed-type 1 and adjustable-type 2 rolling units, that is to say rolling units similar to those already mentioned in the introductory part of this description; in the fixed rolling units 1 there are therefore three rolls whose axes of rotation A1, A2 and A3 are arranged along the sides of an equilateral triangle; the rolls 3 are connected to each other by gears consisting of pairs of bevel gearwheels 5 and 6 with which they are respectively provided; in particular, for each unit 1 there is a single drive input through a shaft 8 positioned horizontally in FIG. 1, and the roll 3 driven by this shaft 8 carries two gears 5 and 6, each of which turns one of the other two rolls by meshing with the gears with which they are provided.

In this type of fixed rolling unit the bearings 10 of the rolls are mounted inside a supporting structure 11 in the form of a frame, which in this particular case is square.

The fixed rolling units shown in FIG. 1 are situated at the start of the rolling mill, i.e. at that end of the latter which is downstream of one of the abovementioned machines from which a semi-finished product emerges for sizing, whereas after the fixed units, along the rolling axis L, are a multiplicity of adjustable rolling units 2 designed for finishing a tube or cylindrical body.

In this example the adjustable units 2 are, apart from a few changes, of the type described in the Italian Patent Application MI94A002661 filed by the owner of this application, already laid open, the description of which should be regarded as incorporated here by reference thereto; these rolling units will therefore only be briefly described hereinbelow as regards their structural characteristics, and for more information the reader should refer, making the appropriate changes, to what is described in the abovementioned application MI94A002661.

Each of the adjustable units bears the general reference 2 in the accompanying drawings and is equipped with an external structure S made up of two plate-like components 26 and 27 of polygonal shape, placed side by side along the rolling axis and connected rigidly to each other by tie rods, which are not shown in the figures; housed inside the structure S is a roll container 30 consisting of a closed frame that can be removed from the structure S in a transverse direction to the axis L. On the structure there are also means for keeping the container 30 locked in the operating position adopted during sizing, for example hydraulic-type means.

Figure 3:
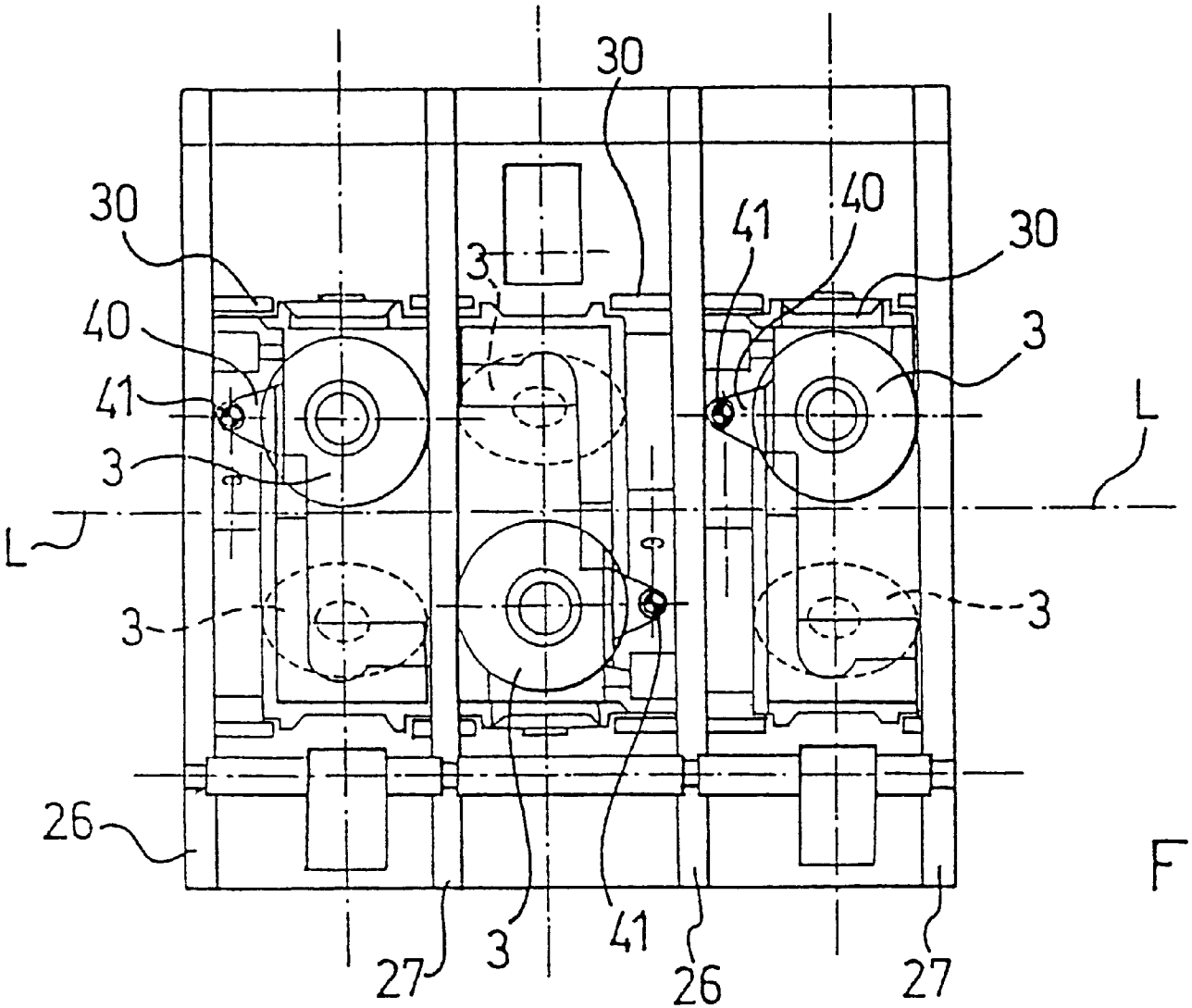
FIG. 3 shows diagrammatically a view on the plane marked III—III in FIG. 2, of the rolling mill according to the invention.

In accordance with a preferred embodiment of the invention, the structures of the adjustable units are arranged side by side in the rolling mill without any separation because each of their components 26 and 27 (see FIG. 3), rigidly connected as already stated by means of tie rods, is also part of the structure of the adjacent unit in the rolling mill; in addition, in order to allow for removal of a container laterally from its housing structure, the latter contains tracks arranged transversely to the rolling axis, along which a container 30 can be moved.

Figure 2:
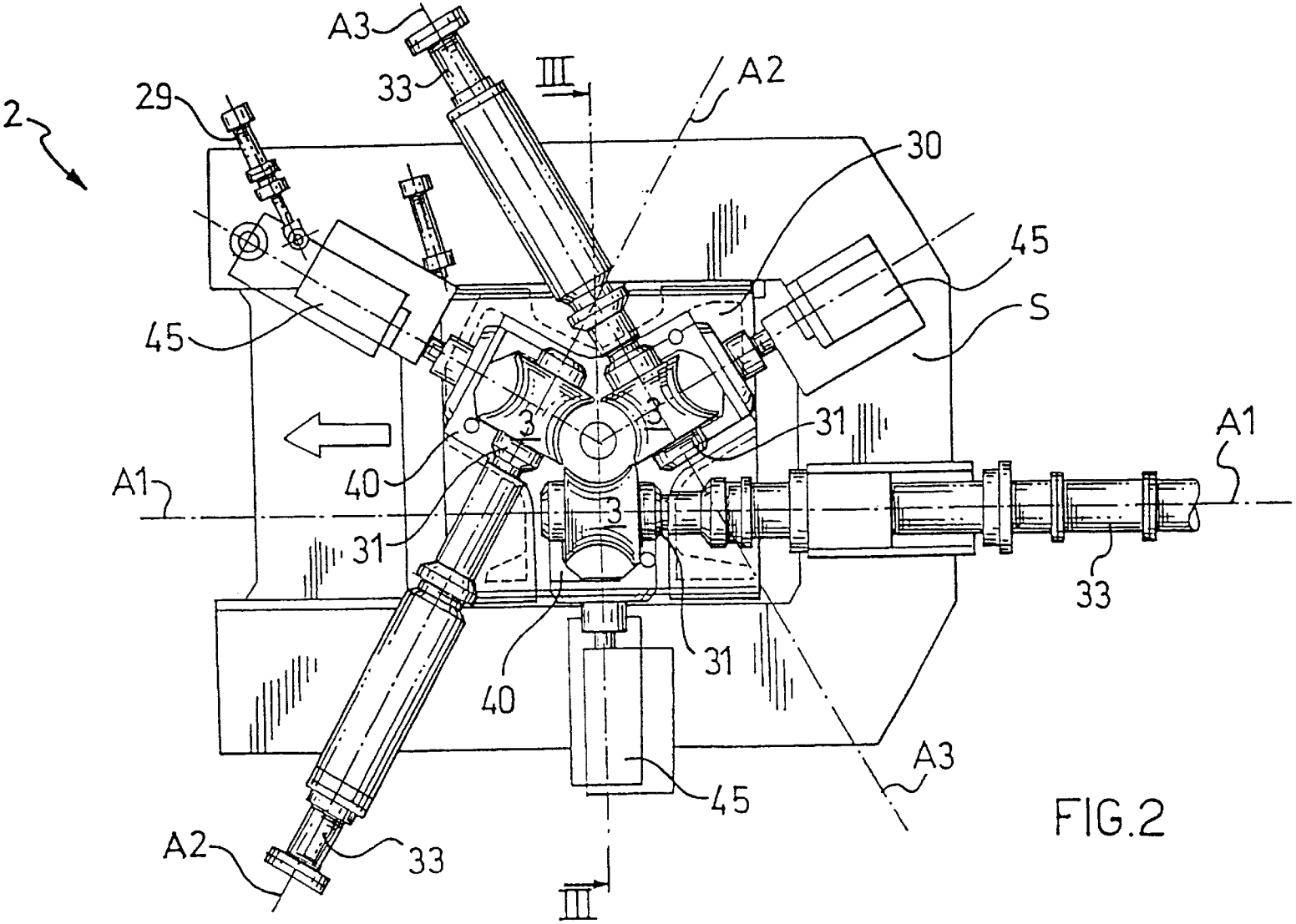
FIG. 2 shows a front view of a second rolling unit which is also present in the rolling mill according to the invention.

To this end, it need only be pointed out that in order for the abovementioned withdrawal of a container to be possible, one of its adjustment mechanisms 45 (more details of which will be given later) which is located on that side of the unit 2 from which a container is extracted as indicated by the arrow in FIG. 2, is hinged to the components 26 and 27 so that it can be rotated in order not to obstruct the movements of the container; a hydraulic actuator 29 acting on the mechanism 45 can be used for this purpose.

The container 30 contains a set of three rolls 3, which are each supported by respective metal blocks with bearings 31 and capable of being set in rotation about their various axes A1, A2 and A3 lying transversely to the rolling axis L; in distinction to the fixed rolling units, each roll in the adjustable units is driven independently of the other two by its own adapter 33 connected to drive means, not illustrated in the drawings.

However, the axes of rotation A1, A2 and A3 are also arranged along the sides of an equilateral triangle.

The rolls 3 with their metal blocks are mounted on respective lever-type arms 40 which are each pivoted about a respective fulcrum consisting of a journal 41 mounted on the container 30, in a plane lying radially with respect to the rolling axis L, that is a plane perpendicular to the axes of rotation A1, A2 and A3 of each roll passing through said rolling axis.

The adjustable rolling unit contains, as was hinted at earlier, mechanisms 45 for adjusting the position of each roll and consisting essentially of hydraulic cylinders in which a fixed part is mounted in the structure S between the latter's two components 26 and 27, while a movable part acts on the metal blocks of the rolls with a forward and backward movement in a radial direction passing through the rolling axis. Again, it is scarcely necessary to point out that these mechanisms could nonetheless be constructed in some other way, for example with electromechanical systems, and that in order to keep the rolls in the open position, i.e. away from the rolling axis even when they are not in contact with work to be sized, the adjustable rolling units also include compensating means for counter-balancing roll weight.

The arrangement of the axes of rotation of the rolls, in both rigid and adjustable rolling units, is staggered, in the sense that the set of three rolls of one rolling unit is revolved about an axis passing through the rolling axis and parallel with one of the axes of rotation A1, A2 and A3, when compared with the adjacent rolling unit of the mill; this gives a more even action all the way around the outer surface of a tube or other body that is to be sized.

The rolling mill also contains means, known per se, for measuring the temperature of a tube or body on which sizing is being carried out. These means are located in the adjustable units and are functionally slaved to a computerized control system that controls the mechanisms 45 that adjust the positions of the rolls in accordance with the particular sizing cycle to be followed; in particular the adjustable rolling units make it possible to carry out any corrections that may be necessary to counteract dimensional changes present in a tube or body arriving from the fixed rolling units 1, as a function of its temperature measured by the means referred to above.

As a consequence of what has been described thus far, as far as sizing is concerned in the rolling mill according to the invention, a tube or body is first rolled by the rolls of the fixed units 1, which undertake the greater amount of the reduction thereof, i.e. reducing the diameter of the semi-finished product down to values close to the desired nominal values, and the adjustable rolling units then undertake the finishing, i.e. take the stock to within the processing tolerances required.

With reference to the diagram of FIG. 4 in the appended drawings, it is possible to provide an indication of the different configurations in which the rolling mill according to the invention can be set up.

More specifically, the numbers in the first column of the matrix shown in FIG. 4 is taken from the series of conventional, gradually increasing diameters that are to be produced, while the numbers 1 to 10 and 11 to 13 along the first horizontal row of the abovementioned matrix indicate the various rolling units present in the rolling mill.

In particular, numbers 1 to 10 indicate fixed units while numbers 11 to 13 correspond to adjustable units. In addition, on the basis of what was reported earlier regarding the revolved arrangement of the sets of three rolls in adjacent units of the mill, it should be borne in mind that the sets of three rolls corresponding to odd-numbered units have the same arrangement as each other, and likewise the sets of three rolls of the even-numbered units are identical while being revolved with respect to the adjacent odd-numbered units.

For each tube or body to be sized, which corresponds to numbers 4 to 12 in the first column, the crosses indicate which rolling units are present in the rolling mill; the number of these will depend on the diameter of the product to be sized. It will be seen that in a preferred embodiment of the invention, the number of adjustable rolling units for each number of total stands used indicated in the first column is always the same, that is, each tube or body on which sizing is being carried out is subjected to the balanced action of sets of three adjustable rolls in revolved positions with respect to each other.

The results achieved with the rolling mill produced in accordance with the invention are noteworthy.

Thus, it will be appreciated that the control of the adjustable rolling units can be carried out more simply than in rolling mills made up entirely of adjustable-type units; this result is due not only to a quantitative aspect, in the sense of a reduction in the number of adjustable rolling units for the same size of rolling mill, but also to a qualitative aspect, which is that since the adjustable rolling units are used for the finishing of a product to be sized, they are subjected to smaller forces and can therefore operate in a loop in which adjustment is governed by feedback on the positions of the rolls, that is to say, the control system operates for the purpose of keeping the rolls in a predetermined position so as to produce the intended nominal diameter for the product to be sized. It is consequently possible to dispense with adjusting the rolls in accordance with a feedback loop that includes the force exerted by the rolls, that is to say an adjustment in which the rolls operate with constant force on a tube or other body undergoing processing.

It should also be borne in mind that in the rolling mill described in the preceding example, the adjustable rolling units may be made much smaller than in a rolling mill of the same size consisting entirely of adjustable-type units all identical to each other; this result is a consequence of the fact that with the particular configuration described above, excellent use is made of the intrinsic structural and functional characteristics of the units employed.

Turning now to the fixed units, these have the virtue of being extremely sturdy and reliable in their operation, being of simple construction: such units are consequently to some extent indicated for working even with high radial forces of separation of the rolls, such as are produced by a tube or other body undergoing processing as it enters the mill. As stated earlier, therefore, the fixed rolling units are used for the main reduction of the semi-finished product and optionally, if the semi-finished product is passed over a mandrel, for removing it as well: the use of fixed rolling units is therefore highly advantageous in this phase.

In the finishing of a tube, i.e. the phase of sizing aimed at producing the intended dimensional tolerances, it is essential to operate with great accuracy: during this phase the radial forces are however very small compared with those which occur at the start of the mill, thus making it advantageous to use adjustable rolling units. Since it is obvious that adjustable rolling units are more expensive than the fixed type, precisely because of the presence of the whole control and adjustment system governing them, the possibility of reducing their dimensions as a response to the diminution in the loads they have to bear, by limiting their use to the final phase of finishing tubes or cylindrical bodies in general, contributes to giving significant economic advantages.

Another important result achieved by the embodiment of the invention described in the preceding example is connected with the use of rolls mounted on supporting arms pivoting in planes that lie radially with respect to the rolling axis; as explained previously in application MI94A002661, the pivoting of the roll supporting arms in radial planes has the great advantage of making it possible to carry out turning machining of the rolls without having harmful effects on the geometry of their groove that acts on the outer surface of a tube or body to be processed, since it should be remembered that this groove generally has a curved profile matching that of the outer surface of the tube or body that is to be rolled, and therefore any removal of material from the roll by turning machining could affect this profile. In other words the pivoting in radial planes of the lever-type arms makes it possible, at least in theory, to re-turn the profile of the groove of the roll an almost unlimited number of times and so keeping its action unchanged over time because the pivoting of the arm can be used to compensate for changes in the dimensions of the roll caused by removal of material, without having to change the position of the finishing rolling unit. This means that the specific consumption of the rolls, and hence the cost of the sizing operation, can be brought down. Put another way, the configuration of the rolling unit with radially pivoting arms with respect to the rolling axis avoids the need for the usual practice in the prior art, described earlier, in which after one or more re-turning operations a rolling stand or a container were shifted back further upstream along the rolling axis, so as to be used on a larger diameter.

Obviously, variations of the invention compared with what has been described thus far are possible; first and foremost it should be pointed out that the adjustable units can be different from those seen above: they will nonetheless have to be of the type that allows adjustment of the positions of the rolls even under load, that is during sizing. By way of indication it may be pointed out also that the rolling mill considered herein could also be constructed not entirely in-line, that is, it is quite possible to move the fixed and adjustable rolling units along separate lines that do not lie in the same direction, as could occur if the reheating furnace were to be installed between the stage of reduction carried out by the fixed units and the finishing stage performed by the adjustable units.

In addition, with reference to what has been set out above, differences may occur in those rolling mills where the reduction effected by the fixed stands takes place, for example, together with an action of stretching the work to be sized and/or in cases in which it may or may not be necessary also to include a step of removing a mandrel from a semi-finished tubular product.

Lastly, it is also possible, in the rolling mill according to the invention, for the pivoting lever-type arms in the adjustable rolling units, which, as has been said, can be of a much lighter design, to be hinged directly to the supporting structure which would be capable of being removed when necessary from the rolling mill because of its low weight. A similar possibility, therefore, is that the roll containers could be removed in the preceding example, and in the same way the supporting structures of the various adjustable-type rolling units could be set up separately from each other, that is, not in the seamless sequence taught in the example described above.

What is claimed is:

1. A rolling mill for reducing a diameter of tubes or cylindrical bodies in general to a final dimension in the iron and steel industries, comprising:

a first multiplicity of fixed-type sizing rolling units arranged in line along a rolling axis and each comprising a supporting structure, at least three rolls rotatably supported in the structure about respective axes of rotation extending transversely to the rolling axis, said rolls being kinematically connected to each other so that said rolls are set in rotation simultaneously by starting only one of said rolls, said rolls rolling the tube or the cylindrical body to obtain a first diameter reduction thereof to a value close the final dimension;

a second multiplicity of adjustable-type sizing rolling units arranged in line along a rolling axis downstream of the fixed-type rolling units and each comprising a supporting structure, at least three driven rolls rotatably supported in the structure about respective axes of rotation extending transversely to the rolling axis, means for adjusting the distance between the axes of rotation of the rolls and the rolling axis during the working of a tube or cylindrical body, said rolls of the adjustable-type sizing rolling units rolling the tube or the cylindrical body to obtain a second diameter reduction thereof within required processing tolerances.

2. A rolling mill according to claim 1, wherein said adjusting means comprises respective lever-type arms supporting the rolls of the adjustable-type rolling units and pivoting in radial planes passing through the rolling axis, thereby enabling adjustment of the distance between the axes of rotation and the rolling axis during the working of a tube or cylindrical body.

3. A rolling mill according to claim 1, wherein the fixed-type and adjustable-type rolling units are arranged in line along a single rolling axis.

4. A rolling mill according to claim 1, further comprising a furnace for reheating the tube or cylindrical body that is to be sized interposed between the fixed-type rolling units and the adjustable-type rolling units.

5. A rolling mill according to claim 1, further comprising means for measuring the temperature of a tube or cylindrical body during its sizing.

6. A rolling mill according to claim 1, wherein the axes of rotation of the rolls of the fixed-type and adjustable-type rolling units are arranged in an essentially triangular configuration lying transversely to the rolling axis of said units, and wherein the essentially triangular arrangement of the axes of rotation of the rolls of one rolling unit is revolved with respect to that of an adjacent rolling unit in the rolling mill, about an axis of revolution passing through the rolling axis and parallel to one of the axes of rotation of the rolls.

7. A rolling mill according to claim 2, wherein the lever-type arms are hinged to a container that can be removed from the supporting structure of the adjustable-type rolling units.

8. A rolling mill according to claim 2, wherein the lever-type arms are hinged to the supporting structure of the adjustable-type rolling units.

9. A rolling mill according to claim 3, further comprising a furnace for reheating the tube or cylindrical body that is to be sized interposed between the fixed-type rolling units and the adjustable-type rolling units.

10. A rolling mill according to claim 6, wherein there is an even number of adjustable-type rolling units.

11. A rolling mill for reducing a diameter of tubes or cylindrical bodies in general to a final dimension, the rolling mill comprising a hybrid processing line of fixed-type sizing rolling units and adjustable-type sizing rolling units arranged in line along a rolling axis, wherein each of the adjustable-type sizing rolling units includes at least three driven rolls supported for rotation about respective axes of rotation, and wherein distances between the rolling axis and the axes of rotation are adjustable, the fixed-type sizing rolling units rolling the tubes or cylindrical bodies to obtain a first diameter reduction thereof to a value close to the final dimension, and the adjustable-type sizing rolling units rolling the tubes or cylindrical bodies to obtain a second diameter reduction thereof within required processing tolerances.

* * * * *